United States Patent [19]

Gooding

[11] 4,354,284

[45] Oct. 19, 1982

[54] PROTECTIVE LINER FOR OUTDOOR HEADGEAR

[75] Inventor: Elwyn R. Gooding, Ann Arbor, Mich.

[73] Assignee: The Regents of the University of Michigan, Ann Arbor, Mich.

[21] Appl. No.: 229,306

[22] Filed: Jan. 28, 1981

[51] Int. Cl.[3] ..... A42B 3/02

[52] U.S. Cl. ..... 2/413

[58] Field of Search ..... 2/413, 414, 411, 416, 2/410

[56] References Cited

U.S. PATENT DOCUMENTS

| | | | |
|---|---|---|---|
| 3,462,763 | 8/1969 | Schneider et al. | 2/413 |
| 3,873,997 | 4/1975 | Gooding | 2/413 |
| 4,023,213 | 5/1977 | Rovani | 2/413 |
| 4,038,700 | 8/1977 | Gyory | 2/413 |

*Primary Examiner*—Peter P. Nerbun

*Attorney, Agent, or Firm*—Olsen and Stephenson

[57] ABSTRACT

An energy-absorbing liner for use in conventional outdoor headgear to provide protection in the event of an impact directed against the wearer's head. A plurality of fluid-filled cushions having walls of resilient material are joined together into a regular and spaced relationship. The connected cushions are mounted over the inside of the outdoor headgear so as to contact and cushion the wearer's head upon impact. In an preferred embodiment, the cushions have two chambers separated by a common wall and are connected by means of flanges along the perimeters of the cushions. The cushions may be interconnected by fluid carrying passages of predetermined cross section to facilitate dispersing of impact forces laterally and may be arranged from a central round or square configuration.

6 Claims, 8 Drawing Figures

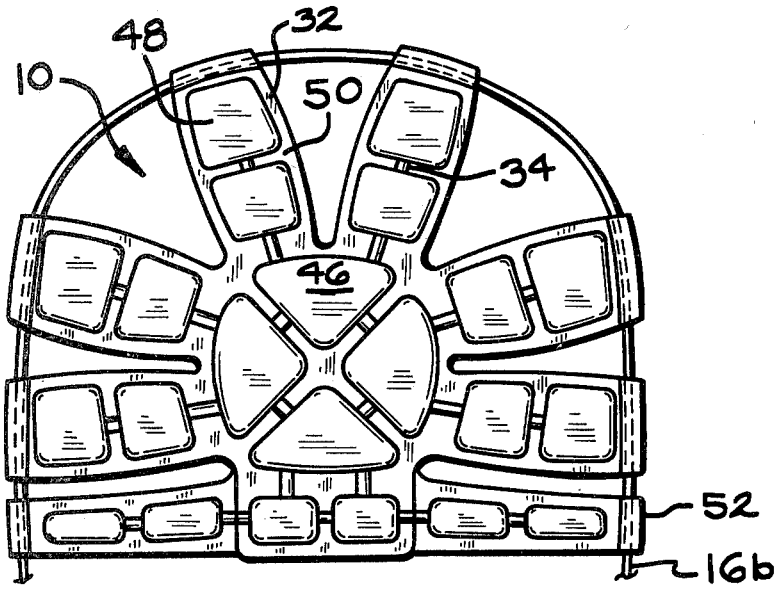
FIG. 6
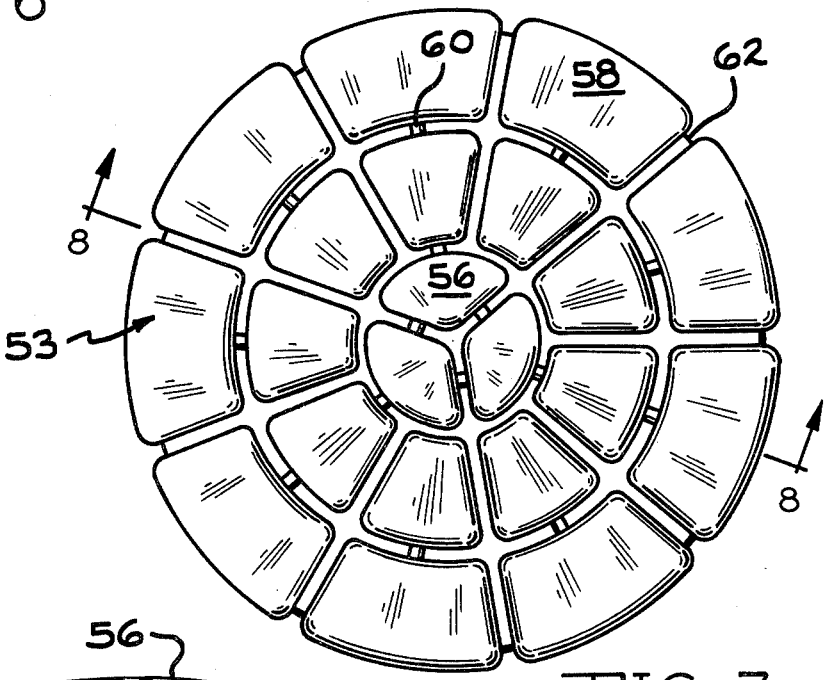
FIG. 7
FIG. 8
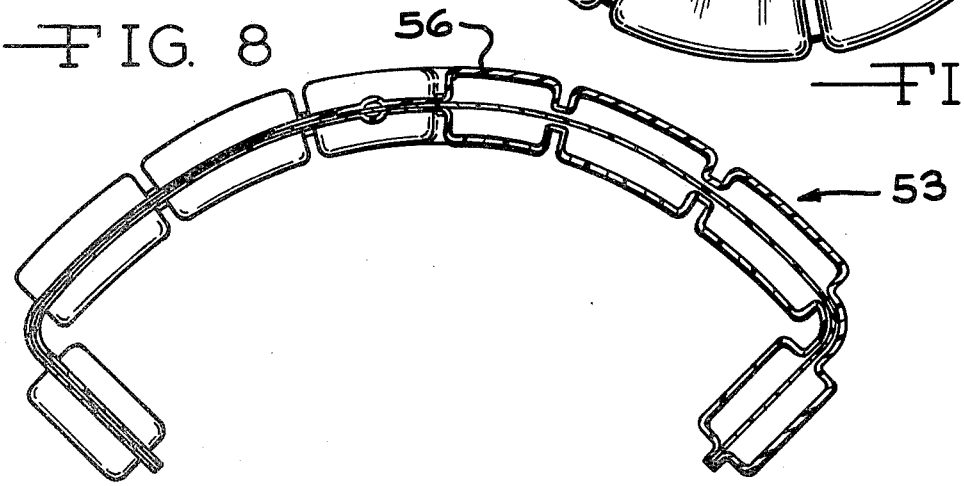

PROTECTIVE LINER FOR OUTDOOR HEADGEAR

BACKGROUND OF THE INVENTION

The present invention relates to protective equipment and, more particularly, to a protective liner which can be incorporated in a variety of designs of outdoor headgear.

In the past, a wide variety of protective headgear has been devised for use by participants in a number of sports, such as football, hockey, and baseball, and for use as crash helmets that protect a wearer's head in the event of a collision. Such headgear has ranged from simple cloth or leather headcoverings with minimal padding to hard outer shells supported upon a network of straps. More recently, as developing technology has made possible the more accurate measurement of forces transmitted through protective headgear and has made available modern materials and techniques, significant improvements have been made with respect to the energy-absorbing characteristics of such headgear.

Consistent with the current state of the art, one of the preferred designs of protective headgear features a relatively hard outer helmet shell in conjunction with a flexible fluid-filled inner liner to support the helmet and dissipate forces applied thereto. However, as illustrated in applicant's U.S. Pat. No. 3,462,763, this current headgear design features an impact-absorbing chin cup strapped over the wearer's chin and a hard outer shell extending to the wearer's neck and over the wearer's ears. Although those features are desirable for use in rugged contact sports, the sacrifice in wearer comfort and convenience, impairment of head motion and hearing, and unfashionable appearance make such helmets unsuitable for general outdoor use or sports having minimal risk of head injury. In addition, such headgear does not protect the wearer from loss of body heat as would be desirable for outdoor winter use in colder climates.

To applicant's knowledge, there has been no protective liner devised for use with conventional outdoor headgear. Such fashionable winter items as skiing berets or beanies and parka or snowsuit hoods have been designed primarily to meet fashion and warmth criteria rather than to protect the wearer from head injury despite the risk of an impact to the wearer's head while walking over ice or while engaging in winter sports. It is, therefore, an object of the present invention to provide a liner for conventional outdoor headgear having substantial energy-absorbing capability without reducing appearance, comfort, and warmth of the headgear below acceptable levels.

SUMMARY OF THE INVENTION

The present invention is an energy-absorbing liner for use in conventional outdoor headgear to provide protection in the event of an impact directed against the wearer's head through the outdoor headgear. A plurality of fluid-filled cushions having walls of resilient material are joined together by connecting means into a regular and spaced relationship. The fluid-filled cushions and connecting means are mountable over the inside of the outdoor headgear such that the fluid-filled cushions contact and cushion the wearer's head in the event of an impact directed to the wearer's head.

In the preferred form of the invention, each of the fluid-filled cushions comprises a pair of chambers separated by a common wall member which is aligned generally parallel to the outward contour of the outdoor headgear. Thus, a first element of each pair of chambers extends toward the wearer's head from the common wall member and the second element of each pair of chambers is positioned radially with respect to the first element and extends away from the wearer's head relative to the common wall member. The pairs of fluid-filled chambers may be connected together by means of a central flange positioned in alignment with the common wall member or by means of an offset flange generally in alignment with the outward contour of the fluid-filled cushions. The individual fluid-filled chambers of adjacent pairs of fluid-filled chambers may be interconnected by fluid-carrying passages of predetermined cross section so as to control the flow of fluid. The connecting means may be formed such that hinge means is provided between adjacent fluid-filled cushions to permit forming of the protective liner in a generally flat configuration which is conformable to the outward contour of the outdoor headgear.

The protective liner of the present invention may be mounted within either conventional or modified outdoor headgear such as skiing berets or beanies and parka hoods. The liner is comfortable and lightweight and is sufficiently flexible such that it does not detract from the appearance, comfort, or warmth of the outdoor headgear. The liner may be filled with air and may be formed economically of plastic by means of various molding or vacuum forming processes and dielectric bonding. The paired relationship of the individual chambers resulting from the dividing common wall member increases the structural stability of the liner and provides additional protection in the event of a partial deflation of the protective liner.

Further objects, features and advantages of the invention will become more fully apparent from the following description of the preferred embodiments of this invention and from the appended claims.

BRIEF DESCRIPTION OF THE DRAWINGS

FIG. 6 is a developed view of the protective liner of FIGS. 1–3 showing the flat configuration thereof prior to bending the liner to conform to the outward contour of the parka hood;

FIG. 7 is a plan view of the protective liner of FIG. 5 showing one means of construction thereof; and FIG. 8 is a sectional view of the protective liner of FIG. 7 along the line 8—8.

DESCRIPTION OF THE PREFERRED EMBODIMENT

Figure 1:
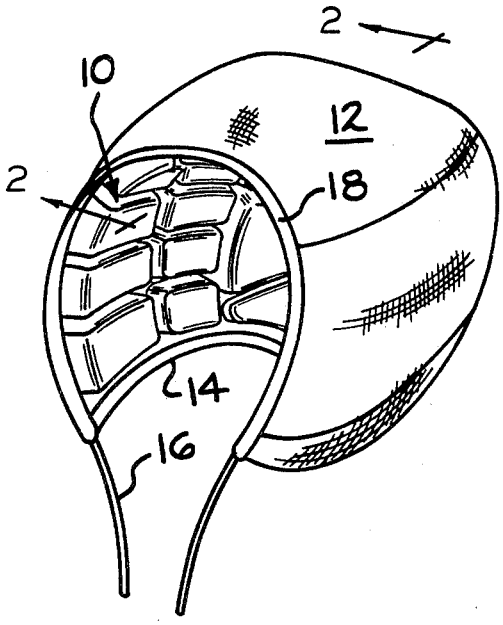
FIG. 1 is a pictorial view of a parka hood showing one embodiment of the protective liner of the present invention with which the parka hood has been fitted.
Figure 2:
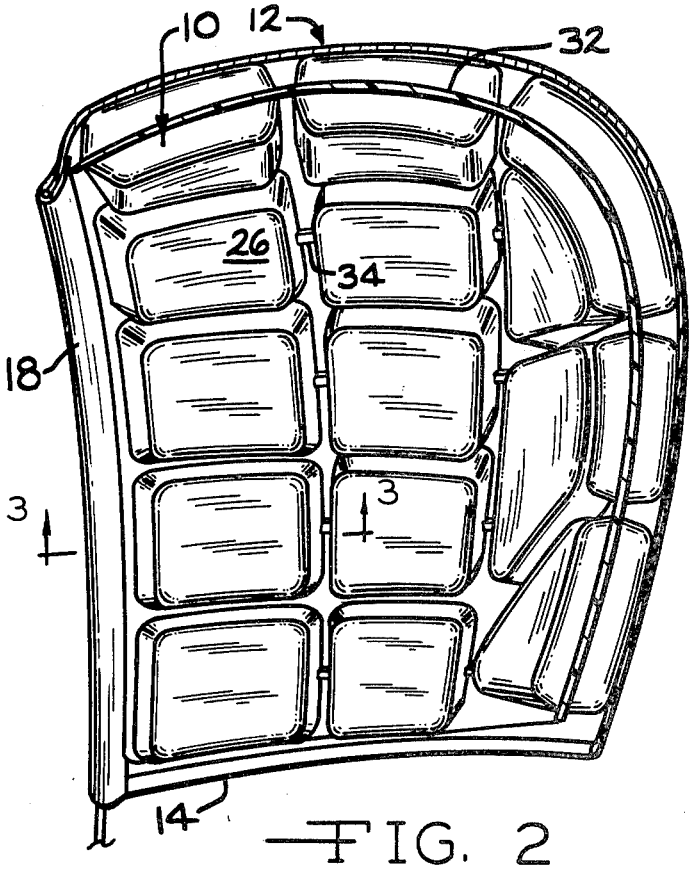
FIG. 2 is a sectional view of the parka hood and protective liner of FIG. 1 along the line 2—2.
Figure 3:
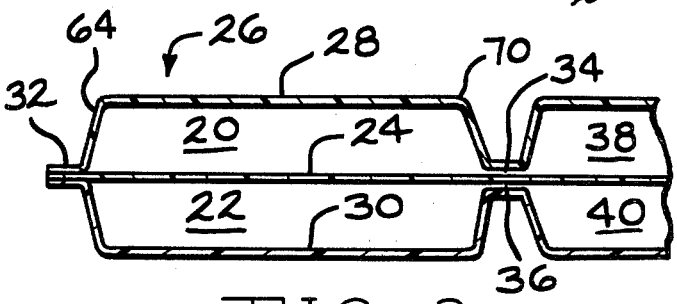
FIG. 3 is a partial sectional view of the protective liner of FIG. 2 along the line 3—3.

With reference to the drawing, a preferred embodiment of the protective liner of the present invention is illustrated in FIGS. 1–3, indicated generally at 10, in assembly relation to a parka hood 12 within which the protective liner 10 is installed. The parka hood 12 is of conventional design and includes a neck portion 14 which conforms to the wearer's neck and a drawstring 16 which draws the hood portion 18 inward about the wearer's face. The parka hood 12 may be made of knit, woven fabric, or other material and may include insulation and other conventional features.

As shown in FIGS. 2 and 3, the protective liner 10 comprises a plurality of pairs of chambers 20 and 22 which are separated by a common wall member 24 and are filled with a fluid. The pairs of chambers 20 and 22 comprise 2-chambered fluid-filled cushions 26 which are aligned with the common wall member 24 generally parallel to the outer contour of the parka hood 12. The individual chambers 20 and 22 are formed by mating concave wall members 28 and 30 which are bonded to the common wall member 24 so as to enclose a fluid within the individual chambers 20 and 22 and form an external flange 32 along the perimeter of the chambers in alignment with the common wall member 24. The mating concave wall members 28 and 30 are molded or vacuum formed by conventional methods into geometric shapes which are positionable so as to conform to and cover the inner contour of the parka hood 12. In the embodiment shown, the chambers 20 and 22 are generally triangular or pie-shaped adjacent the back of the wearer's head and are generally trapezoid shaped adjacent the top and sides of the wearer's head.

The flanges 32 along the perimeter of the chambers 20 and 22 are extended between adjacent cushions 26 so as to connect all the cushions 26 and unite them into a single protective liner 10. In the embodiment shown, fluid-filled passages 34 and 36 interconnect chamber 20 to chamber 38 and chamber 22 to chamber 40, respectively, so as to control the flow of fluid between the adjacent chambers. The fluid-carrying passages 34 and 36 are formed in the flange 32 between the mating concave wall member 28 and 30 and the common wall member 24. Applicant has found that the controlled flow of fluid between adjacent chambers 20 and 22 distributes an impact force laterally over a larger area of the wearer's head and aids in absorbing the impact energy. In cross section, the fluid-carrying passages 34 and 36 are of rectangular or semicircular shape and are flexible enough to permit the protective liner to conform to the outer contour of the parka hood 12.

Figure 4:
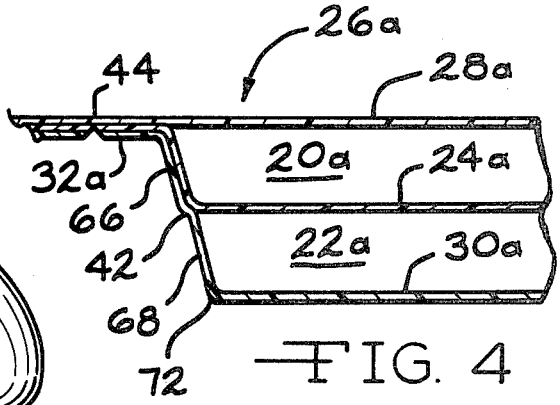
FIG. 4 is a partial sectional view of an alternative construction of the present invention which is analogous to the structure shown in FIG. 3.

An alternative construction of the cushions 26 is shown in FIG. 4 with the corresponding elements identified with the suffix a. In this configuration, the flange **32*a* along the perimeter of the fluid-filled chambers 20*a* and 22*a* is offset from alignment with the common wall member 24*a* so as to present a more regular outward contour to the parka hood 12. The mating wall member 28*a* has a flat rather than concave configuration. The common wall member 24*a* has a concave configuration and is bonded to the wall member 28*a* at the flange 32*a* to enclose the fluid within the chamber 20*a*. The mating wall member 30*a* is more deeply concave than the common wall member 24*a* and is bonded to the common wall member 24*a* at the flange 32*a* so as to enclose a fluid and form the fluid-filled chamber 22*a*. Additionally, the mating wall member 30*a* and the common wall member 24*a* are bonded along the side wall portion 42 so as to increase the stability of the cushion 26*a* and increase the resistance to penetration by an impacting object. The flange 32*a* may be thinned between adjacent cushions 26*a* as at hinge area 44 so as to increase the flexibility of the protective liner 10 and improve its ability to conform to the contour of the parka hood 12**.

The protective liner of the present invention may be formed in a generally flat configuration as shown in the developed view of FIG. 6 and may be bent along flange areas between adjacent cushions 25 so as to conform to the contour of a parka hood as illustrated in FIG. 1. In this embodiment, there are four pie-shaped cushions 46 which form a round pad positionable adjacent the back of the wearer's head, and the remaining cushions 48 are aligned radially from the pie-shaped cushions 46 within strap-like configurations 50 of the flanges 32. Tubes 52 may be formed in the ends of the strap-like configurations 50 to receive the drawstring 16 to facilitate drawing the protective liner 10 around the wearer's head. Alternatively, the cushion construction of FIG. 4 could be utilized in a flat liner construction analogous to that shown in FIG. 6.

Figure 5:
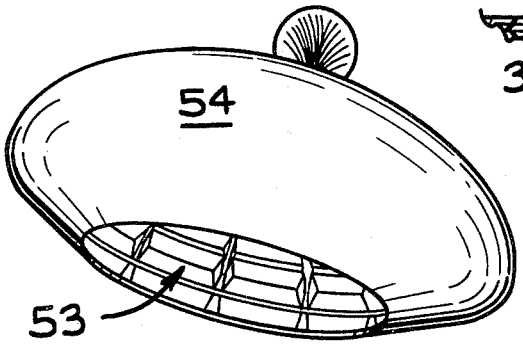
FIG. 5 is a pictorial view of a skiing beret or beanie showing a second embodiment of the protective liner of the present invention with which the skiing beret or beanie has been fitted.

A similar protective liner 53 designed for use within a skiing beret or beanie 54 is illustrated in FIGS. 5, 7 and 8. As shown in plan view in FIG. 7, the protective liner 53 has a daisy flower shape characterized by a central round portion of three pie-shaped cushions 56 and generally trapezoid shaped cushions 58 radiating therefrom as nine petals. The cushions 56 and 58 may have the construction described above with respect to FIG. 3, as specifically shown in FIGS. 7 and 8, or the alternative construction as described above with respect to FIG. 4. Again, interconnecting fluid-carrying passages 60 may be utilized to distribute impact forces laterally to adjacent cushions and to assist in absorbing impact energy. The nine petal-like portions of the liner formed by the trapezoid shaped cushions 58 may be formed as separate strap-like extensions of the central round portion analogous to the construction illustrated in FIG. 6. Alternatively, the nine petal-like portions may be joined together circumferentially by extensions of the flange 32 or **32*a* as illustrated in FIG. 7**.

Applicant has found that polyurethane or a blend of vinyl-polyurethane is a preferred material for the protective liner of the present invention. The preferred construction is by dielectric bonding of cushion sections which are air blow molded and preinflated with air. However, roto molding or vacuum forming and alternative bonding means could also be used. Further, liquids or gases other than air could be utilized. The preferred configuration includes radiused corners at 70 and 72 and a clearance angle of approximately ten degrees at side walls 64, 66, and 68 to facilitate molding procedures, increase the hinging ability between the cushions, and increase wearer comfort. Applicant has found that a dielectric seal area 0.040 inch wide is suitable for a primary bonded area and that a secondary or safety bonding area of 0.100 inch wide may be added to decrease the risk of rupture of the chambers and the fluid-carrying passages.

It will be seen from the foregoing description of the preferred embodiments that the present invention provides a protective liner which is suitable for a variety of conventional outdoor headgear. The protective liner of the present invention provides substantial energy adsorption capability and dissipates impact forces laterally to protect the wearer from impact directed to the wearer's head through the outdoor headgear. Further, it can be seen that this protective liner is soft, convenient and comfortable and does not interfere with appearance as would conventional protective headgear having a hard outer shell, chin cup, and stiff extensions to the neck and over the ears of the wearer. While the preferred embodiment has been described in considerable detail, the present invention is not to be limited to such detail except as may be necessitated by the appended claims.

What is claimed is:

1. An energy-absorbing protective liner for use in conventional outdoor headgear, said liner comprising:

a plurality of resilient wall members secured together in a surface-to-surface relation so as to form a plurality of fluid-filled chambers having walls of resilient material confining the fluid within said chambers, said fluid-filled chambers being formed in pairs positionable concentrically about the wearer's head, each of said pairs including an inner fluid-filled chamber adjacent the wearer's head and an outer fluid-filled chamber to be positioned adjacent the outdoor headgear, one of said wall members dividing said inner fluid-filled chamber and said outer fluid-filled chamber and forming a common wall therebetween, each of said inner and outer chambers being positioned side-by-side with a similar chamber and being in fluid communication therewith through a fluid carrying passage, said liner being mountable against the inside of said outdoor headgear such that when the headgear is worn said liner is between said headgear and the wearer's head so that said liner will cushion and disperse impact blows directed to the wearer's head through the outdoor headgear and absorb impact forces applied to said headgear and thereby diminish the magnitude of those forces on the head of the wearer.

2. An energy-absorbing protective liner as defined in claim 1 wherein said chambers are formed in pairs separated by said one wall member of resilient material, said one wall member being disposed generally parallel to the contour of the outdoor headgear such that the chambers present two concentric layers about the wearer's head, said fluid carrying passages being formed by positioning said one wall member in a closely spaced relation with the other ones of said wall members.

3. An energy-absorbing protective liner as defined in claim 2 wherein said wall members are formed of resilient material bonded together along the perimeters of said wall members with common wall member between two of said mating wall members located on opposite sides of said dividing wall member and being formed with facing sections of concave configuration which form a plurality of side-by-side 2-chambered cushions in said liner.

4. An energy-absorbing protective liner as defined in claim 3 wherein said bonding along said perimeter forms an external flange located in substantial alignment with said one wall member which divides said inner and outer chambers.

5. An energy-absorbing protective liner as defined in claim 4 wherein some of said 2-chambered cushions are generally of triangular shape and are positioned so as to form a generally square pad and the remaining 2-chambered cushions are generally of trapezoid shape and are positioned radially with respect to said square pad.

6. An energy-absorbing protective liner as defined in claim 4 wherein some of said 2-chambered cushions are generally pie-shaped and are positioned so as to form a generally round pad and the remaining 2-chambered cushions are generally of trapezoid shape and are positioned radially with respect to said round pad.

* * * * *